United States Patent [19]

Hamisch, Jr.

[11] Patent Number: 4,611,537

[45] Date of Patent: Sep. 16, 1986

[54] PRINT HEAD

[75] Inventor: Paul H. Hamisch, Jr., Franklin, Ohio

[73] Assignee: Monarch Marking Systems, Inc., Dayton, Ohio

[21] Appl. No.: 672,660

[22] Filed: Nov. 19, 1984

[51] Int. Cl.[4] ..... B41J 1/60

[52] U.S. Cl. ..... 101/111; 101/105; 101/110

[58] Field of Search ..... 101/105, 110, 111

[56] References Cited

U.S. PATENT DOCUMENTS

| | | | |
|---|---|---|---|
| 164,273 | 6/1875 | Dorman | 101/111 X |
| 994,971 | 6/1911 | Beck | 101/111 |
| 1,067,448 | 7/1913 | Standley | 101/110 X |
| 3,482,512 | 12/1969 | Jung | 101/111 |
| 3,796,152 | 3/1974 | Finke et al. | 101/111 |
| 3,972,281 | 8/1976 | Sams | 101/111 X |
| 4,055,118 | 10/1977 | Sato | 101/111 X |
| 4,163,422 | 8/1979 | Hamisch, Jr. | 101/111 |
| 4,233,896 | 11/1980 | Hamisch, Jr. | 101/110 |
| 4,271,758 | 6/1981 | Osterhof | 101/110 |
| 4,271,759 | 6/1981 | Volk | 101/110 |
| 4,280,862 | 7/1981 | Hamisch, Jr. | 101/292 X |
| 4,283,832 | 8/1981 | Hamisch, Jr. | 101/111 X |
| 4,290,358 | 9/1981 | Hamisch, Jr. | 101/111 |
| 4,325,302 | 4/1982 | Beers | 101/111 X |
| 4,334,470 | 6/1982 | Hamisch, Jr. | 101/105 X |
| 4,337,698 | 7/1982 | Jenkins | 101/111 |
| 4,524,686 | 6/1985 | Karn | 101/111 |

FOREIGN PATENT DOCUMENTS

| | | | |
|---|---|---|---|
| 46898 | 3/1982 | Japan | 101/111 |
| 1179025 | 1/1970 | United Kingdom . | |

*Primary Examiner*—Edgar S. Burr
*Assistant Examiner*—James R. McDaniel
*Attorney, Agent, or Firm*—Joseph J. Grass

[57] ABSTRACT

There is disclosed a printing band print head having a one-piece, dimensionally accurate, mounting block with integral end plates, the mounting block having a cradle for rotatably supporting drive wheels, printing bands with long printing characters and short human readable characters, a selector cooperable with any selected drive wheel, the selector being easy to assemble and including a knob connected to a selector shaft, an indicator axially shiftable as a unit with the selector, the selector shaft being rotatable with respect to the indicator, a sleeve on the shaft, and the sleeve having detent means and driver means. Printing bands coupled to the drive wheels pass about direction changing means and a support.

5 Claims, 9 Drawing Figures

PRINT HEAD

BACKGROUND OF THE INVENTION

1. Field of the Invention

The Invention relates to selectable print heads.

2. Brief Description of the Prior art

The following U.S. Pat. Nos. are made of record: 164,273 to Dorman granted June 8, 1875; 994,971 to Beck granted June 13, 1911; 1,067,448 to Standley granted July 15, 1913; 3,482,512 to Jung granted Dec. 9, 1969; 4,163,422 to Hamisch, Jr. granted Aug. 7, 1979; 4,233,896 to Hamisch, Jr. granted Nov. 18, 1980; 4,271,758 to Osterhof granted June 9, 1981; 4,271,759 to Volk granted June 9, 1981; 4,280,862 to Hamisch, Jr. granted July 28, 1981; 4,283,832 to Hamisch, Jr. granted Aug. 18, 1981; 4,325,302 to Beers granted Apr. 20, 1982; and 4,337,698 to Jenkins granted July 6, 1982. Also made of record is British Pat. No. 1,179,025 to "WAM" published Jan. 28, 1970.

SUMARY OF THE INVENTION

It is a feature of the invention to provide a dimensionally accurate print head provided by a mounting block and an integral end plate or flange at one end of the mounting block, wherein the mounting block is cored out through the one end and the plate or flange extends outwardly from the coring.

It is preferred that the other end of the mounting block be provided with an end plate generally aligned with the coring so that both ends of the mounting block are restrained.

In accordance with a specific embodiment, the mounting block has a concave mounting surface and a pair of end plates molded integrally with the block. The mounting surface mounts a series of drive wheels coupled to printing members. The one end plate comprises a flange molded integrally with and extending outwardly from the outer side periphery at one end portion of the mounting block adjacent the coring. The other end plate is spaced from the one end plate and preferably extends along the other end portion of the mounting block. A third end plate has a guide hole for a selector which is cooperable with any selected drive wheel. The print head of the invention has relatively few parts and is easy to manufacture. It is preferred that the shape of the block and the flange integral therewith be in a generally hat-shaped configuration.

DESCRIPTION OF THE PREFERRED EMBODIMENT

Figures 1, 2, 3:
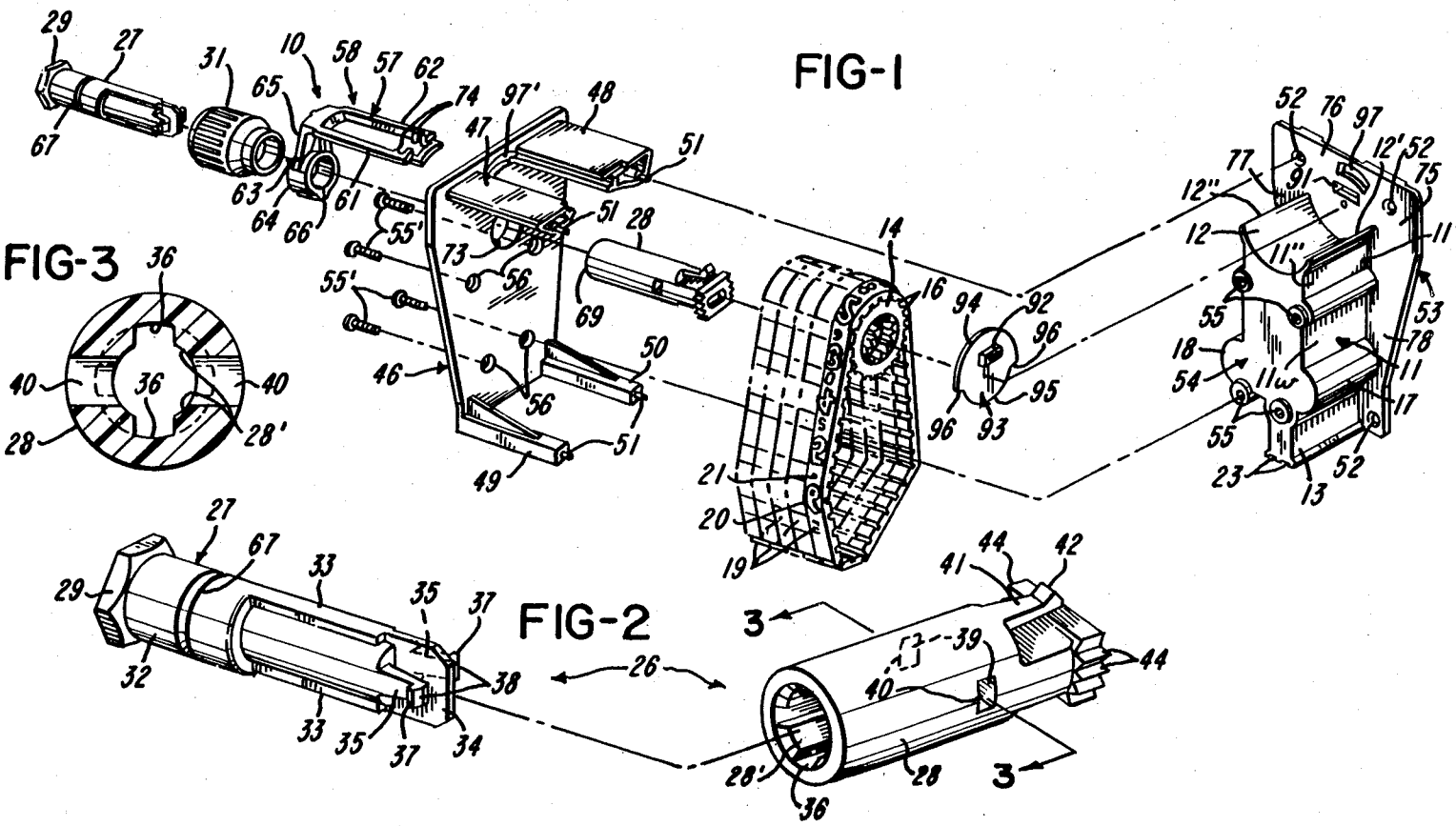
FIG. 1 is an exploded perspective view of a print head in accordance with the invention.
FIG. 2 is an enlarged exploded perspective view of a selector also shown in FIG. 1.
FIG. 3 is a sectional view taken generally along line 3—3 of FIG. 2.
Figure 9:
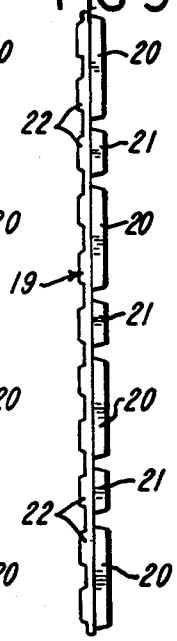
FIG. 9 is an elevational view taken along line 9—9 of FIG. 8.

With reference to FIG. 1, there is shown a print head generally indicated at 10, which includes a mounting block generally indicated at 11 with an arcuate, elongate concave mounting surface or cradle 12. A support 13 is preferred, as shown, to be integral with the mounting block 11, rather than using the conventional square idler wheels. A series of drive wheels 14 having notches 15 which define teeth 16 are rotatably supported or cradled on the surface 12. The mounting block 11 has a pair of elongate projections 17 and 18. A series of printing bands 19 are trained about the drive wheels 14, the projections 17 and 18 and the support 13. The length of the path about a drive wheel 14, the projections 17 and 18 and the support 13 is matched to the required length of the bands 19. Each printing band 19 has printing characters 20 and human readable characters 21. As shown, the printing characters 20 are substantially higher or longer than the human readable characters 21. The underside of each printing band 19 has lugs or teeth 22 received in notches 15 of the respective drive wheel 14. There are two lugs 22 on the underside of each printing character 20 and there is one lug 22 on the underside of each human readable character 21 as best illustrated in FIG. 9. Thus, the pitch of the printing characters is two and the pitch of the human readable characters is one. The support 13 has two recesses or notches 23 for receiving two lugs 22. The notches 23 receive the lugs 22 and serve to detent the printing bands. The support 13 can support one printing character 20 at a time at a printing position or zone Z (FIG. 6).

Figure 6:
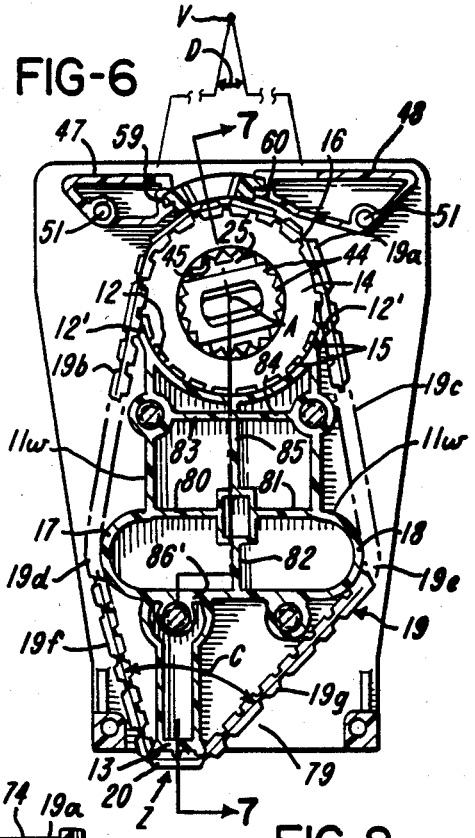
FIG. 6 is a sectional view taken generally along line 6—6 of FIG. 5.

The drive wheels 14 have aligned central holes 24 defining an axial opening 25 (FIG. 6). The opening 25 is adapted to receive a selector generally indicated at 26. The selector 26 is shown to include a selector shaft 27 and a sleeve 28 received about the selector shaft 27. The selector shaft 27 has a hex-shaped head 29 received in a mating hex-shaped socket 30 of a knob 31. Thus, the knob 31 is secured against rotation on the selector shaft 27. The selector shaft 27 has an annular shaft portion 32, a pair of spaced spline portions 33 and an end portion 34. The shaft 27 also has a pair of oppositely sprung flexible resilient spring fingers or latch members 35 adjacent the end portion 34. The sleeve 28 has spline grooves 36 adapted to receive the spline portion 33. When the sleeve 28 is slipped over the shaft 27, teeth 37 on the ends of spring fingers 35 are cammed inwardly. Inclined cam surfaces 38 on the teeth 37 aid in inserting the shaft 27 into the sleeve 28. As the end portion 34 abuts an end wall 38 inside the sleeve 28, the spring fingers 35 spring outwardly as the teeth 37 enter holes 39 in the sleeve 28. The holes 39 have shoulders 40 which extend perpendicularly to the axis of the sleeve 28. The teeth 37 extend against shoulders 40 defined by a side of the hole 39. Each spring finger 35 and its tooth 37 cooperating with a shoulder 40 constitutes a latch. The shaft 27 and the sleeve 28 are latched together and cannot be separated without simultaneously pushing inwardly laterally against the teeth 37 until the teeth 37 clear the shoulders 40 and thereupon moving the shaft 27 out of the opening 28' in the sleeve. Thus, merely pulling on the knob 31 will not release the sleeve 28 which has been assembled onto the shaft 27.

The sleeve 28 has a pair of outwardly sprung flexible resilient detent fingers or detents 41 with end portions or teeth 42 releasably engaged in a selected recess formed by adjacent bevels at the holes 24 in the drive wheels 14. The sleeve 28 also has two sets of teeth 44 which engage in notches 45 in the drive wheels 14. Thus, rotation of the selector 26 causes the drive wheel 14 with which teeth 44 are engaged to rotate that drive wheel 14. The detents 41 releasably hold the selector 28 in a selected axial position coupled to the selected drive wheel 14. The selector 28 can be shifted axially by pulling or pushing on the knob 31.

Figure 7:
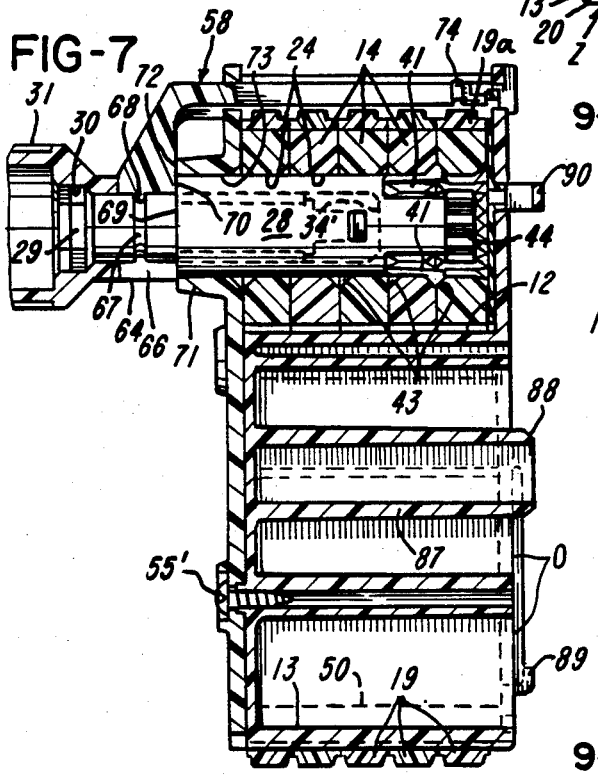
FIG. 7 is a sectional view taken generally along line 7—7 of FIG. 6.
Figure 8:
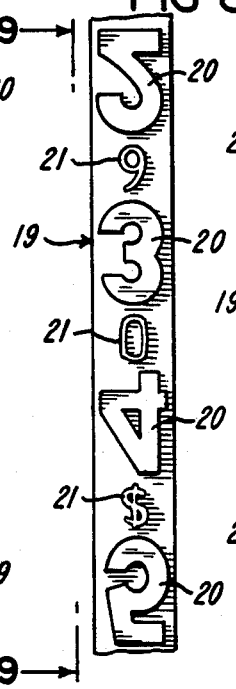
FIG. 8 is a fragmentary elevational view of a printing band.

An end plate 46 is shown to have integrally molded members 47, 48, 49 and 50. The members 47 through 50 have locators 51 received in locator-receiving recesses 52 in an end plate 53. The end plate 53 is molded integrally to the one portion 11' of the mounting block 11. The other end portion 11'' of the mounting blocks 11 has an integrally molded end plate 54. The mounting block 11 has an outer side periphery or peripheral side wall **11*w* disposed between end portions 11' and 11''. Tubular locators 55 on the end plate 54 interfit with locator-receiving recesses or holes 56 in the end plate 46. The locators 51 and 55 and their respective locator-receiving recesses 52 and 56 locate the end plate 46 relative to end plates 53 and 54 and to the drive wheels 14. Screws 55' pass through holes 56 and are threadably received in the tubular locators 55. The members 47 and 48 act as guides for a longitudinal indicator portion 57 of an indicator generally indicated at 58. The guides 47 and 48 have respective grooves 59 and 60 which receive elongated flanges 61 and 62. The indicator 58 also has a transverse mounting portion 63 which includes a split collar 64 and an integral connector 65 connecting the indicator portion 57 and the split collar 64. The collar 64 extends for almost 360° but has a narrow opening 66 which enables the collar 64 to expand when the indicator 58 is assembled onto the selector shaft 27. The selector shaft 27 has a continuous annular groove 67. The collar 64 has a projection 68 received in the groove 67. The collar 64 is received directly on the selector shaft 27. In assembling the print head 10, the shaft 27, the knob 31 and the indicator 58 are assembled as a unit, and the grooves 67 and the cooperating projection retain these parts as a subassembly. The indicator portion 57' are thereafter inserted through the clearance hole 97' and the selector shaft 27 is simultaneously inserted through the opening 73 preparatory to the sleeve 28 being slid onto the shaft 27. Terminal end 69 of the sleeve 28 abuts against terminal end 70 of the collar 64. The terminal end 70 of the collar 64 also abuts terminal end 72 of a tubular projection 71 on the end plate 46 in the position shown in FIG. 7. An opening or bore 73 in the end plate 46 and its projection 71 slidably receives the sleeve 28. As shown, the collar 64 is held captive between the knob 31 and the sleeve 28 so that the indicator 58 cannot shift axially relative to the selector 26. However, the selector 28 and the indicator 58 are shiftable axially as a unit. In addition, the shaft 27 is free to rotate relative to the indicator 58 when the user rotates the knob 31. The indicator portion 57 has a pair of pointers 74 axially aligned with the teeth 44. Thus, the pointers 74 always indicate to the user the drive wheel 14 and hence the printing band 19 to which the selector 26 is drivingly coupled. The disclosed arrangement of the selector shaft 27 and the sleeve 28 with strong driving members 44 enable wheels 14 with relatively large central holes, as shown, to be driven using a relatively small number of small parts. As seen in the drawings, the size of the selector shaft 27, the knob 31, and the collar 64 are no longer than those that would be used in a print head with small drive wheels with small central holes. As best shown in FIG. 7, the sleeve 28, not the shaft 27, is in guided sliding contact with the hole 73**.

Figure 4:
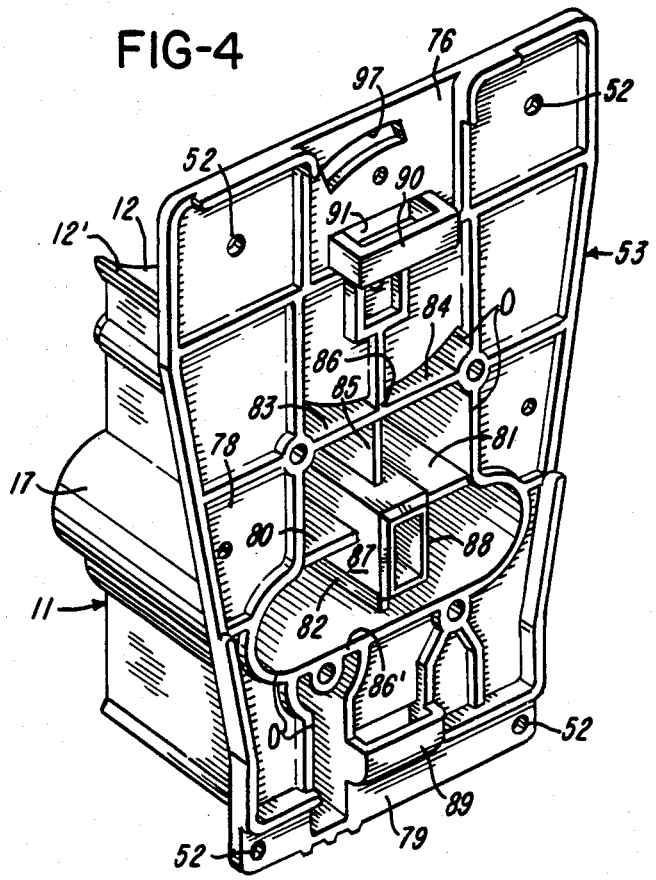
FIG. 4 is an enlarged perspective view of a mounting block also shown but in a different plane than in FIG. 1.
Figure 5:
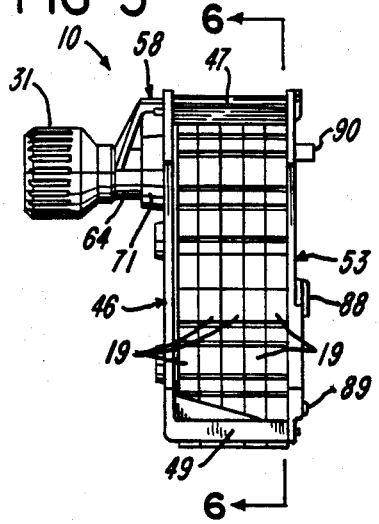
FIG. 5 is a side elevational view of the assembled print head.

The mounting block 11 is constructed in such a way as to provide improved dimensional stability even though it is molded of plastics material. The inside of the mounting block 11 is cored-out or hollow but, unlike prior art print heads, both ends of the mounting block are integrally molded with an end wall. As best shown in FIGS. 4 and 7 the coring opens to the outside of the block 11 at the opening 0 at end portion 11'. The end wall 54 extends continuously across one end portion of the mounting block 11. The end plate 53 includes a flange 75 which extends outwardly of the opening 0. The flange 75 has an upper generally horizontal flange portion 76 joined to a pair of generally vertical flange portions 77 and 78, and a lower generally horizontal flange portion 79 joined to the vertical portions 77 and 78. The end walls 53 and 54 help maintain the dimensional stability of the mounting block particularly when this one-piece molding part is removed from the mold and cools. Both end portions of the mounting block 11 are restrained so as to maintain its dimensional accuracy. Dimensional accuracy is important because the path length of the printing bands 19 must be correct if the printing bands 19 are to be under the proper tension. The distance from the cradle 12 to the bottom end of the support 13 is critical. In the illustrated embodiment the dimension of the projections 17 and 18 relative to each other and to the cradle 12 and the end of the support 13 is also critical. It is apparent that by maintaining dimensional accuracy, the printing bands can be trained about the drive wheels 14, over the projections 17 and 18 and about the support 13 under proper tension to assure proper detenting of the bands 19 at the support 13 without adjusting devices such as springs. The flange portions 77 and 78, the end plate 54 and the wall **11*w* comprise a hat-section at any horizontal plane (as viewed in FIGS. 1 and 6) from the ends 12' and 12'' to and including the support 13**.

As shown in FIGS. 4, 6 and 7, the essentially hollow mounting block 11 has internal ribs 80, 81, 82, 83, 84, 85, 86 and 86'. The hollows in the mounting block 11 are provided by coring. The cored-out interiors define the ribs 80 through 86' and a tubular section 87. The ribs 80, 81, 82 and 85 are joined to the rectangular tubular section 87 defining a projection or post 88. The post 88, a socket 89 and a U-shaped member 90 are used to mount the print head 10 to a slide (not shown) and serve the same respective functions as the post, the socket and the U-shaped member on the print head disclosed in co-owned U.S. Pat. No. 4,280,862, incorporated herein by reference. The ribs 80 through 86' and the section 87 also assist in maintaining the dimensional accuracy of the mounting block 11.

The flange portion 76 which is above one end of the cradle 12 has a rectangular opening or hole 91 into which a rectangular projection 92 on a spacer 93 is plugged. The spacer 93 has a semi-circular upper portion 94 and a semi-circular lower portion 95. The portion 94 has a larger radius than the portion 95. The portion 94 has horizontally aligned spaced downwardly facing shoulders or ears 96 which bear against ends or end portions 12' and 12'' of the cradle 12. The lower portion 93 extends toward but is spaced from the cradle 12. The upper portion 94 is alongside the endmost wheel 14 and extends alongside the portion 19*a* of the adjacent endmost band 19. The portion 19*a* is engaged with the wheel 14. The spacer 93, thus, cannot shift or rotate even if the adjacent endmost wheel 14 is driven by the selector 26. The upper portion 94 extends beyond the root radius of the wheel 14. The root radius of the wheel 14 is measured from the center of curvature to the roots or bases of the teeth 16. The end plate 53 also has a clearance hole 97 for the indicator 58.

Typically, a support or anvil which supports a printing character at a printing position is narrower in width than the outer diameter of the drive wheel used to drive the printing band. The free portions of the printing band pass directly from the drive wheel and converge toward the support. When a concave drive wheel mounting surface or cradle is used as in co-owned U.S. Pat. No. 4,233,896, the arcuate extent of the mounting surface is necessarily limited. There is some tendency of a driven drive wheel to ride up the concave surface or cradle. More particularly, if the drive wheel is driven in one direction upon rotation of the selector, then the driven drive wheel will tend to ride up one side of the cradle, and conversely if the drive wheel is driven in the opposite direction upon rotation of the selector, then the drive wheel will tend to ride up the other side of the cradle.

It has been found that by having the free portions of the printing band diverge away from the drive wheel, the arcuate extent of the cradle can be substantially increased, thus better supporting the drive wheel against such riding-up. By diverging the free portions of the printing bands away from the drive wheels the arcuate extent of the cradle can be substantially increased. As best shown in FIG. 6, a pair of free band portions 19*b* and 19*c* join the engaged portion 19*a* which is in engaged contact with the respective drive wheel 14. The free portions 19*b* and 19*c* are unsupported and diverge downwardly (as viewed in FIG. 6) for example and outwardly from the drive wheel 14 and the engaged portion 19*a*. The free portions 19*b* and 19*c* are narrowly spaced from and do not contact respective ends 12' and 12". Each printing band 19 also has supported portions 19*d* and 19*e* which pass about respective direction-changing members 17 and 18. The supported portions 19*d* and 19*e* are joined to free unsupported portions 19*f* and 19*g*. The free portions 19*f* and 19*g* converge from the supported portions 19*d* and 19*e* toward the single printing character 20 at the printing zone Z. Another feature of the disclosed arrangement is that by using the direction-changing members 17 and 18 each printing band 19 can be substantially longer while providing a print head of ordinary height or length. Thus, a labeler as disclosed in U.S. Pat. No. 4,280,862 can utilize the print head 10 of the present application, with the added advantage that the printing bands of the present application are substantially longer. Such a capability is particularly desirable because different models having different capabilities can be provided using the same basic labeler. As seen in the drawings, the printing characters 20 are relatively large.

The pointers 74 on the indicator 58 point to the human readable character 21 which corresponds to the printing character 20 at the printing zone Z. For example, if a printing character 20 "5" is at the printing zone Z, then a human readable character 21 "5" is between pointers 74. When the printing band 19 is advanced, the printing band 19 is moved through a distance equal to three pitches to bring the adjacent printing character 20 to the printing zone Z, and this also causes the corresponding human readable character 21 to be brought between the pointers 74.

By way of example, not limitation, each printing band 19 is 175.3 mm in length, one pitch is equal to 3.8 mm, the printing characters 20 are 7 mm high or long, the angle D of divergence of the band portions 19*b* and 19*c* is 20 degrees, the angle C of convergence is 59.5 degrees, the distance between the axis A and the underside of the support is 59.5 mm, the outside dimension cross the direction-changing members 17 and 18 is 36.4 mm, the diameter of drive wheel 14 is 24.3 mm and the distance between the ends 12' and 12" is 23.4 mm and the arcuate extent of the surface 12 is at least 130° and preferably about 140°. The axis A which is generally on the radius of curvature of the surface 12 lies between vertex V of angle D and the support 13.

The printing bands 19 are preferably constructed of elastomeric material, the screws 55' are metal, and the remainder of the print head 10 is molded of plastics material.

Other embodiments and modifications of the invention will suggest themselves to those skilled in the art, and all such of these as come within the spirit of this invention are included within its scope as best defined by the appended claims.

I claim:

1. A print head, comprising: a longitudinally extending mounting block having spaced end portions and internal coring, the mounting block being of molded plastics construction and including an elongate mounting surface extending between the end portions, a series of drive wheels rotatably supported on the mounting surface, means for supporting printing bands at a printing position, a series of printing bands trained about the drive wheels and the supporting means, the mounting block further including a first end plate molded integrally with one end portion and extending transversely of the mounting block, a second end plate molded integrally with the other end portion and being in alignment with the internal coring, wherein the wheels have aligned holes defining an axially extending opening, and a third end plate secured to the second end plate, the third end plate having an opening, and a selector received in the opening in the third end plate and received in the axially extending opening for selectively driving any drive wheel.

2. A print head, comprising: a mounting block having spaced end portions, the mounting block including an elongate concave mounting surface extending between the end portions, wherein the mounting block has elongate coring providing a hollow, a series of drive wheels rotatably supported on the mounting surface, means for supporting printing bands at a printing position, a series of printing bands trained about the drive wheels and the supporting means, the mounting block further including a first end plate molded integrally with one end portion and extending outwardly beyond the mounting block, a second end plate molded integrally with the other end portion, wherein the mounting block and the supporting means are integrally molded, and wherein the second end plate substantially closes off the entire other end portion.

3. A print head, comprising: a mounting block having spaced end portions and internal coring, the mounting block being of molded plastics construction and including an elongate concave mounting surface extending in a longitudinal direction between the end portions, a series of drive wheels rotatably supported on the mounting surface, means for supporting printing bands at a printing position, a series of printing bands trained about the drive wheels and the supporting means, the mounting block further including a first end plate molded integrally with one end portion and extending transversely beyond the mounting block, a second end plate molded integrally with the other end portion and being in alignment with the internal coring, wherein the wheels have aligned holes defining an axially extending opening, a third end plate secured to the second end plate, the third end plate having an opening, a selector received in the opening in the third end plate and received in the axially extending opening for selectively driving any drive wheel, and wherein mounting block and the supporting means are integrally molded.

4. A print head, comprising: a mounting block having spaced end portions with an outer side periphery disposed between the end portions, the outer periphery including a concave mounting surface extending between the end portions, a series of drive wheels rotatably supported on the mounting surface, means for supporting the printing bands at a printing position, a series of printing bands trained about the drive wheels and the supporting means, the mounting block having coring extending from an opening at one of said end portions into the interior of the mounting block, a first end plate including a flange molded integrally with and extending outwardly from the outer side periphery of said one end portion of the mounting block adjacent the coring, and a second end plate molded integrally with the other end portion, and wherein the flange, the mounting block and the second end plate are in a generally hat-shaped configuration, wherein the second end plate provides a top, the mounting block provides spaced sides and the flange provides a brim of the hat-shaped configuration.

5. A print head, comprising: a longitudinally extending mounting block having spaced end portions, the mounting block being of molded plastics construction and including an elongate concave mounting surface extending between the end portions, wherein the mounting block has elongate coring providing a hollow, a series of drive wheels rotatably supported on the mounting surface, means for supporting printing bands at a printing position, a series of printing bands trained about the drive wheels and the supporting means, the mounting block further including a first end plate molded integrally with one end portion and extending transversely outwardly of the mounting block, a second end plate molded integrally with the other end portion, wherein the second end plate extends across an end of the hollow, and wherein the second end wall is substantially continuous across the other end portion.

* * * * *